US008112904B2

(12) United States Patent
Kono et al.

(10) Patent No.: US 8,112,904 B2
(45) Date of Patent: Feb. 14, 2012

(54) DRUM-TYPE WASHER/DRYER

(75) Inventors: Tetsuyuki Kono, Tokyo (JP); Tatsuya Saito, Tokyo (JP); Tatsuo Ioku, Tokyo (JP); Satoru Nishiwaki, Tokyo (JP)

(73) Assignees: Kabushiki Kaisha Toshiba, Tokyo (JP); Toshiba Home Appliances Corporation, Tokyo (JP); Toshiba Consumer Electronics Holdings Corporation, Tokyo (JP)

( * ) Notice: Subject to any disclaimer, the term of this patent is extended or adjusted under 35 U.S.C. 154(b) by 423 days.

(21) Appl. No.: 12/094,937

(22) PCT Filed: Oct. 17, 2006

(86) PCT No.: PCT/JP2006/320643

§ 371 (c)(1),
(2), (4) Date: Oct. 9, 2009

(87) PCT Pub. No.: WO2007/060796

PCT Pub. Date: May 31, 2007

(65) Prior Publication Data

US 2010/0024239 A1 Feb. 4, 2010

(30) Foreign Application Priority Data

Nov. 25, 2005 (JP) ..... 2005-340481

(51) Int. Cl.
*F26B 11/00* (2006.01)

(52) U.S. Cl. ..... 34/595; 34/601; 34/201; 68/5 R

(58) Field of Classification Search ..... 34/80, 82, 34/90, 601, 595, 610, 201; 68/5 R, 19
See application file for complete search history.

(56) References Cited

U.S. PATENT DOCUMENTS

| | | | | |
|---|---|---|---|---|
| 2,627,669 | A * | 2/1953 | Candor | 34/547 |
| 3,691,649 | A | 9/1972 | Pigors | |
| 3,805,404 | A * | 4/1974 | Gould | 34/75 |
| 4,891,892 | A * | 1/1990 | Narang | 34/86 |
| 5,042,171 | A * | 8/1991 | Obata et al. | 34/604 |
| 6,282,928 | B1 | 9/2001 | Fukumoto et al. | |
| 6,378,341 | B1 | 4/2002 | Wiemer et al. | |
| 6,748,772 | B2 * | 6/2004 | Lee et al. | 68/18 C |
| 6,966,124 | B2 * | 11/2005 | Ryu | 34/134 |

(Continued)

FOREIGN PATENT DOCUMENTS

CN 1231357 10/1999

(Continued)

OTHER PUBLICATIONS

Search Report from PCT/JP2006/313486 dated Aug. 8, 2006.

(Continued)

*Primary Examiner* — Stephen M. Gravini
(74) *Attorney, Agent, or Firm* — DLA Piper LLP US

(57) ABSTRACT

A drum-type washer/dryer having an evaporator for performing dehumidification by cooling air drawn from the inner space of a drum and also having condenser for heating the air dehumidified by the evaporator, wherein the air heated by the condenser is made to sequentially pass through a duct and a blowhole and blown as dry air to clothes in the drum. A backflow preventing portion is provided in the duct, and when bubbles flow back into the duct from the inner space of the drum through the blowhole, the backflow preventing portion functions as resistance for preventing the back flow of the bubbles.

4 Claims, 8 Drawing Sheets

U.S. PATENT DOCUMENTS

| | | | | |
|---|---|---|---|---|
| 7,024,795 | B2 * | 4/2006 | Tadano et al. | 34/76 |
| 7,296,443 | B2 | 11/2007 | Usherovich et al. | |
| 7,520,145 | B2 * | 4/2009 | Hong et al. | 68/12.27 |
| 7,814,770 | B2 * | 10/2010 | Jeon et al. | 68/13 R |
| 7,866,061 | B2 * | 1/2011 | Tatsumi et al. | 34/595 |
| 2003/0056393 | A1 * | 3/2003 | Lee et al. | 34/595 |
| 2004/0079121 | A1 | 4/2004 | Yabuuchi et al. | |
| 2005/0246920 | A1 | 11/2005 | Yabuuchi et al. | |
| 2010/0024239 | A1 * | 2/2010 | Kono et al. | 34/76 |
| 2010/0107703 | A1 * | 5/2010 | Hisano et al. | 68/20 |

FOREIGN PATENT DOCUMENTS

| | | | | |
|---|---|---|---|---|
| CN | 1497091 | A | | 5/2004 |
| DE | 10255575 | | | 12/2003 |
| DE | 69922864 | | | 6/2008 |
| EP | 0911438 | | | 4/1999 |
| EP | 0942093 | A1 | | 9/1999 |
| EP | 1197592 | | | 4/2002 |
| EP | 1411163 | A2 | | 4/2004 |
| JP | 47-8921 | | | 4/1972 |
| JP | 48-12593 | B1 | | 4/1973 |
| JP | S63-183095 | | | 7/1988 |
| JP | H02-148697 | | | 12/1990 |
| JP | H06-335599 | | | 12/1994 |
| JP | 10071292 | A | * | 3/1998 |
| JP | H11-114273 | | | 4/1999 |
| JP | 2000-225286 | | | 8/2000 |
| JP | 2004-135715 | | | 5/2004 |
| JP | 2004-135755 | | | 5/2004 |
| JP | 2004-337519 | | | 12/2004 |
| JP | 2005-27734 | A | | 2/2005 |
| JP | 2005-27768 | | | 2/2005 |
| JP | 2005-034163 | | | 2/2005 |
| JP | 2005-46414 | | | 2/2005 |
| JP | 2005-052533 | | | 3/2005 |
| JP | 2005-052534 | | | 3/2005 |
| JP | 2005137646 | A | * | 6/2005 |
| JP | 2005-224414 | A | | 8/2005 |
| JP | 2005-318917 | A | | 11/2005 |
| JP | 2006015118 | A | * | 1/2006 |
| JP | 2006122466 | A | * | 5/2006 |
| JP | 2006314839 | A | * | 11/2006 |
| JP | 2006314840 | A | * | 11/2006 |
| KR | 2004-0100894 | | | 12/2004 |
| WO | WO 03057968 | A1 | * | 7/2003 |

OTHER PUBLICATIONS

Search Report from PCT/JP2006/316870 dated Oct. 10, 2006.
English Abstract of JP-A-2000-225286 published Aug. 15, 2000.
English abstract of JP-A-H11-114273 published Apr. 27, 1999.
English abstract of JP-A-2005-46414 published Feb. 24, 2005.
Chinese Office Action issued in corresponding Application No. 200680005481.9 mailed Mar. 6, 2009.
English translation of Chinese Office Action issued in corresponding Application No. 200680005481.9 mailed Mar. 6, 2009.
English Abstract of JP 2005-052533 published Mar. 3, 2005.
Notice of Submission of Argument issued on Mar. 16, 2009 in corresponding Korean patent application No. 7020455/2007.
English translation of Notice of Submission of Argument issued on Mar. 16, 2009 in corresponding Korean patent application No. 7020455/2007.
English Abstract of KR 2004-0100894 published Dec. 2, 2004.
Machine English language translation of JP 2005-034163 dated Feb. 10, 2005.
English Abstract of JP 2005-034163 dated Feb. 10, 2005.
English Language Abstract of JP 2005-27768 published Feb. 3, 2005.
English Language Abstract of JP H06-335599 published Dec. 6, 1994.
English Language Abstract of JP 2004-337519 published Dec. 12, 2004.
English Language Abstract of JP 2004-135715 published May 13, 2004.
Machine Language Translation of JP 2005-27768 published Feb. 3, 2005.
Machine Language Translation of JP 2004-135755 published May 13, 2005.
Machine Language Translation of JP H06-335599 published Dec. 6, 1994.
Machine Language Translation of JP 2004-337519 published Dec. 2. 2004.
Machine Language Translation of JP 2004-135715 published May 13, 2004.
United Kingdom Office Action issued in GB0716373.6 on Jul. 13, 2009.
Office Action issued in Chinese Application 200680027088 on Aug. 14, 2009.
English Abstract of JP 2005-052534 published Mar. 3, 2004.
English machine translation of JP 2005-052534 published Mar. 3, 2004.
English machine translation of JP 2005-052533 published Mar. 3, 2005.
Office Action issued in CN Appl 200680042899.7 on Nov. 20, 2009.
English Abstract of CN 1231357 published Oct. 13, 1999.
English Translation of Office Action issued in CN Appl 200680042899.7 on Nov. 20, 2009.
Office Action issued in Japanese Appl 2005-045612 on Feb. 9, 2010.
English Abstract of Japanese Publication No. H02-148697 on Dec. 18, 1990.
English Translation of Office Action issued in Japanese Appl 2005-045612 on Feb. 9, 2010.
File History of U.S. Appl. No. 11/816,568.
File History of U.S. Appl. No. 11/996,677.
File History of U.S. Appl. No. 12/094,065.
English Abstract of JP 2005-318917A published Nov. 17, 2008.
Machine English Translation of JP 2005-318917A published Nov. 17, 2008.
Machine English Translation of JP 2000-225286 published Aug. 15, 2000.
Machine English Translation of JP 2005-224414 published Aug. 25, 2005.
Machine English Translation of JP H11-114273 published Apr. 27, 1999.
Machine English Translation of JP 2005-46414 published Feb. 24, 2005.
Machine English Translation of JP 2005-27734 published Feb. 3, 2005.
English Language Abstract of DE 10255575 published Dec. 11, 2003.
German Office Action issued in DE 11 2006001946.5-26 on Apr. 1, 2011.
English Translation of German Office Action issued in DE 11 2006001946.5-26 on Apr. 1, 2011.
Office Action issued in JP Appl 2005-334367 on Mar. 8, 2011.
English Translation of Office Action issued in JP Appl 2005-334367 on Mar. 8, 2011.
U.S. Appl. No. 11/996,677.
International Search Report from PCT/JP2006/320643.
English Abstract of JP-2004-135755.
English Abstract of JP-2005-224414A.
English Abstract of JP-2005-27734.
English Language Translation of Chinese Office Action issued on Aug. 14, 2009 in CN Appl. 200680027088.X.
English Language Abstract of CN 1497091 published May 19, 2004.
Japanese Office Action issued in JP 2005-215959 on Mar. 8, 2011.
English Translation of Japanese Office Action issued in JP 2005-215959 on Mar. 8, 2011.
Concise Explanation of relevance of JP47-8921 published Apr. 5, 1972.
U.S. Appl. No. 11/816,568.
U.S. Appl. No. 12/094,065.
Supplementary European Search Report issued in EP 06783099.2 on May 20, 2011.
English Language Abstract of DE 69922864 published Jun. 9, 2005.

* cited by examiner

UPWARD

RIGHT

DRUM-TYPE WASHER/DRYER

FIELD OF THE INVENTION

The present invention relates to a drum-type washer/dryer provided with a heat pump drying mechanism.

BACKGROUND ART

One of the above-described drum-type washer/dryers is disclosed by Japanese Patent Publication No. 2004-135755 (Prior art document 1). The disclosed drum washer/dryer comprises a drum into which laundry is put and a water-receiving tub receiving water discharged from the laundry in the drum. A blowhole is provided in the water-receiving tub so that air is fed to an inner space of the drum therethrough. A duct is connected to the blowhole. The duct constitutes part of a looped circulation passage having a start and an end thereof in the inner space of the drum and is joined to the water-receiving tub. The drum washer/dryer comprises a condenser, an evaporator and a blower. The condenser is housed in the circulation passage so as to be located upstream of the duct. The evaporator is housed in the circulation passage so as to be located upstream of the condenser. The evaporator cools air drawn from the inner space of the drum, thereby dehumidifying the air. The condenser heats the air dehumidified by the evaporator, thereby increasing a temperature of the air. Laundry in the drum is dried by causing the air heated by the condenser to blow through the duct and the blowhole in turn.

DISCLOSURE OF THE INVENTION

Problem to be Overcome by the Invention

The drum-type washer/dryer disclosed in prior art document 1 is constructed to carry out a wash operation in an air circulation stopped state. In the wash operation, laundry is washed using water containing detergent. Accordingly, bubble flows back from the inner space of the drum through the blowhole into the duct during the wash operation. As a result, there is a possibility that the bubble flowed back into the duct may adhere to the condenser and the evaporator.

An object of the present invention is to provide a drum-type washer/dryer which can prevent the bubble flowed back into the duct from adhering to the condenser and the evaporator.

Means for Overcoming the Problem

The present invention provides a drum-type washer/dryer which incorporates a drum into which laundry is put and comprises a water-receiving tub receiving water discharged from the laundry in the drum, a blowhole provided in the water-receiving tub so that air is fed to an inner space of the drum therethrough, a duct connected to the blowhole, an air circulation passage having a start and an end thereof in the inner space of the drum and formed into a loop, the air circulation passage including the duct, a blower drawing air from the inner space of the drum and circulating the air in such a direction that the air is returned through the duct and the blowhole in turn into the inner space of the drum, a condenser provided in the circulation passage so as to be located upstream of the duct relative to the blowhole, an evaporator provided in the circulation passage so as to be located upstream of the condenser, and a compressor causing a refrigerant to flow into the evaporator and the condenser, characterized in that the duct includes a backflow preventing portion which serves as a resistance preventing backflow of a bubble when the bubble flows back from the inner space of the drum through the blowhole into an interior of the drum, the backflow preventing portion has a smaller cross-sectional area than a remaining portion of the duct, the cross-sectional area being obtained by fracturing the duct along a section line perpendicular to a flowing direction of the air in the duct.

Effect of the Invention

According to the invention, when a bubble in the drum flows back from the blowhole into the duct, the backflow preventing portion serves as a resistance to prevent the backflow of the bubble. Consequently, the bubble can be prevented from coming out of the duct thereby to adhere to the condenser and the evaporator.

EXPLANATION OF REFERENCE SYMBOLS

Reference symbol 11 designates a water-receiving tub, 24 a drum, 34 an evaporator, 35 a condenser, 36 a compressor, 39 a blower, 40 a duct, 47 a blowhole, 48 a circulation passage, 52 a backflow preventing portion, 53 a control device, 54 a left duct, and 55 a right duct.

BEST MODE FOR CARRYING OUT THE INVENTION

Figure 1:
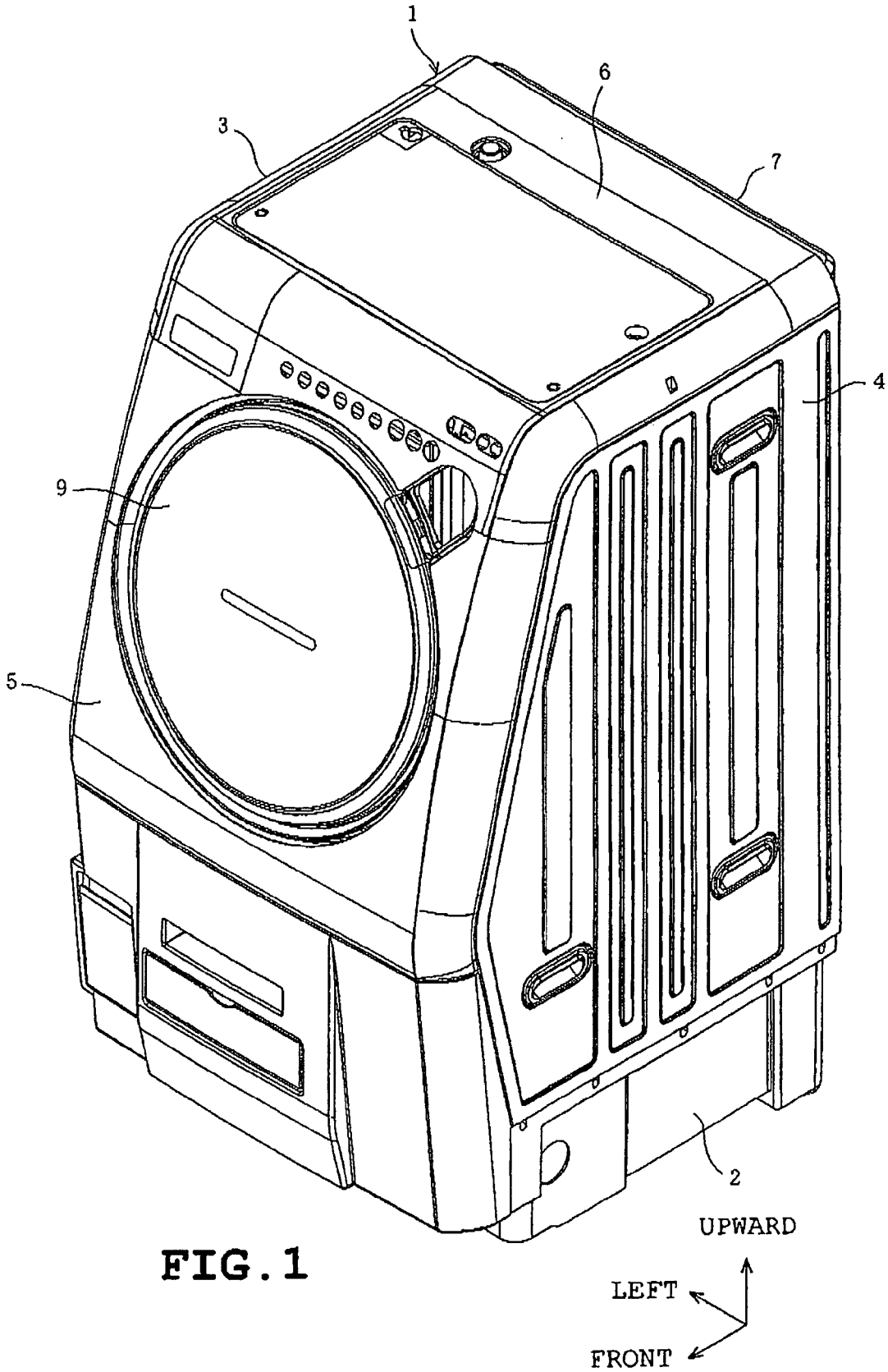
FIG. 1 is a perspective view of a drum washer/dryer of one embodiment of the invention.
Figure 2:
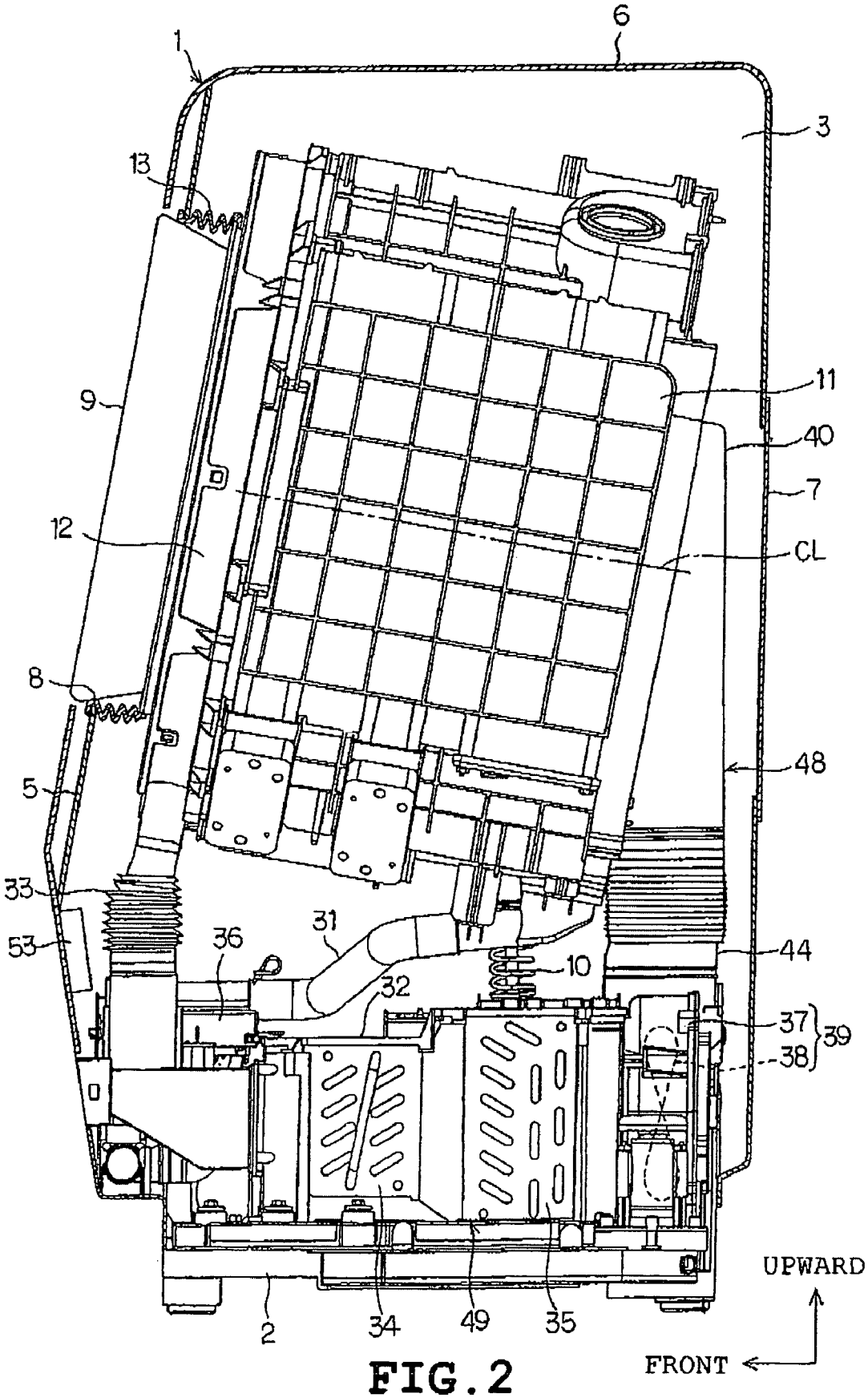
FIG. 2 is a side view of the drum washer/dryer with an outer cabinet thereof being broken away, showing an inner construction.

The invention will be described in more detail with reference to the accompanying drawings. FIGS. 1 to 7 illustrate one embodiment of the invention. An outer cabinet 1 is constructed by joining a baseplate 2, a left side plate 3, a right side plate 4, a front plate 5, a ceiling plate 6 and a rear plate 7 to one another as shown in FIG. 1. The front plate 5 is formed with a circular access opening 8 as shown in FIG. 2. A circular door 9 is mounted on the front plate 5 so as to be pivotable between a closing state where the access opening 8 is closed by the door 9 and an open state where the access opening 8 is opened by the door 9.

A plurality of dampers 10 are housed in the outer cabinet 1 as shown in FIG. 2. Each damper 10 employs oil as an operating fluid and a metal spring as a recovering spring and is fixed to the baseplate 2. A water-receiving tub 11 made from a synthetic resin is mounted on rods of the dampers 10 thereby to be housed in the outer cabinet 1 in a damped and shock-absorbed state. The water-receiving tub 11 is formed into the shape of a bottomed cylinder with a closed rear and is disposed in such an inclined state that an imaginary shaft center line CL becomes lower from a front part thereof to a rear part thereof. The water-receiving tub 11 has a front end to which a water-receiving tub cover 12 is fixed. The cover 12 is formed into an annular shape and surrounds the water-receiving tub 11. A bellows 13 made of rubber has a rear end fixed to an inner circumference of the water-receiving tub 12. The bellows 13 is formed into a cylindrical shape and fixed to an inner circumference of the access opening 8.

Figure 4:
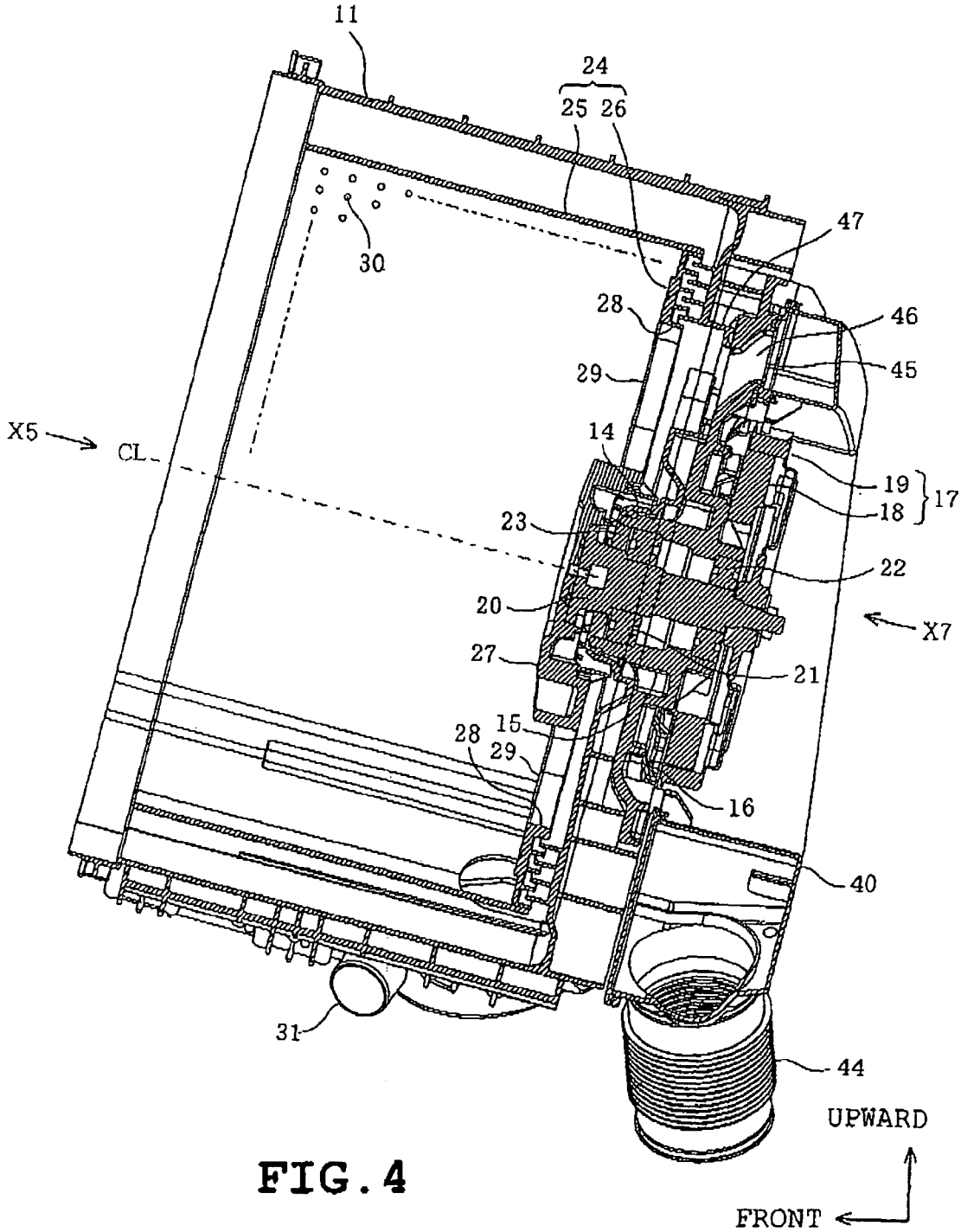
FIG. 4 is a sectional view taken along line 4-4 in FIG. 5.

The rear plate of the water-receiving tub 11 is formed with a cylindrical motor support 14 as shown in FIG. 4. A cylindrical bearing bracket 15 is inserted into the motor support 14. The bearing bracket 15 has an annular motor mounting 16 fixed to the rear plate of the water-receiving tub 11. A drum motor 17 includes a stator 18 fixed to the motor mounting 16. The drum motor 17 includes a rotor 19 rotatably mounted around the stator 18 and is accordingly formed into an outer rotor type. The drum motor 17 includes a rotational shaft 20 fixed to the rotor 19. The rotational shaft 20 has a front end extending through the bearing bracket 15, protruding into an interior of the water-receiving tub 11. A front bearing 21 includes an outer ring fixed to an inner circumferential surface of the bearing bracket 15 so as to be located at a front end of the surface. A rear bearing 22 includes an outer ring fixed to the inner circumferential surface of the bearing bracket 15 so as to be located at a rear end of the surface. Each of the front and rear bearings 21 and 22 comprises a radial bearing including the cylindrical outer ring, an cylindrical inner ring having a smaller diameter than the outer ring and a plurality of balls interposed between the outer and inner rings. The rotational shaft 20 is fixed to inner rings of the front and rear bearings 21 and 22, whereby the rotational shaft 20 is rotatably mounted in the bearing bracket 15. A seal ring 23 is fixed to the bearing bracket 15. The seal ring 23 has an inner circumference into which an outer circumference of the rotational shaft 20 is inserted so as to be in contact with the inner circumference of the seal ring 23. As a result, the seal ring 23 watertightly seals a gap between the outer circumference of the seal ring 23 and the inner circumference of the bearing bracket 15.

Figure 5:
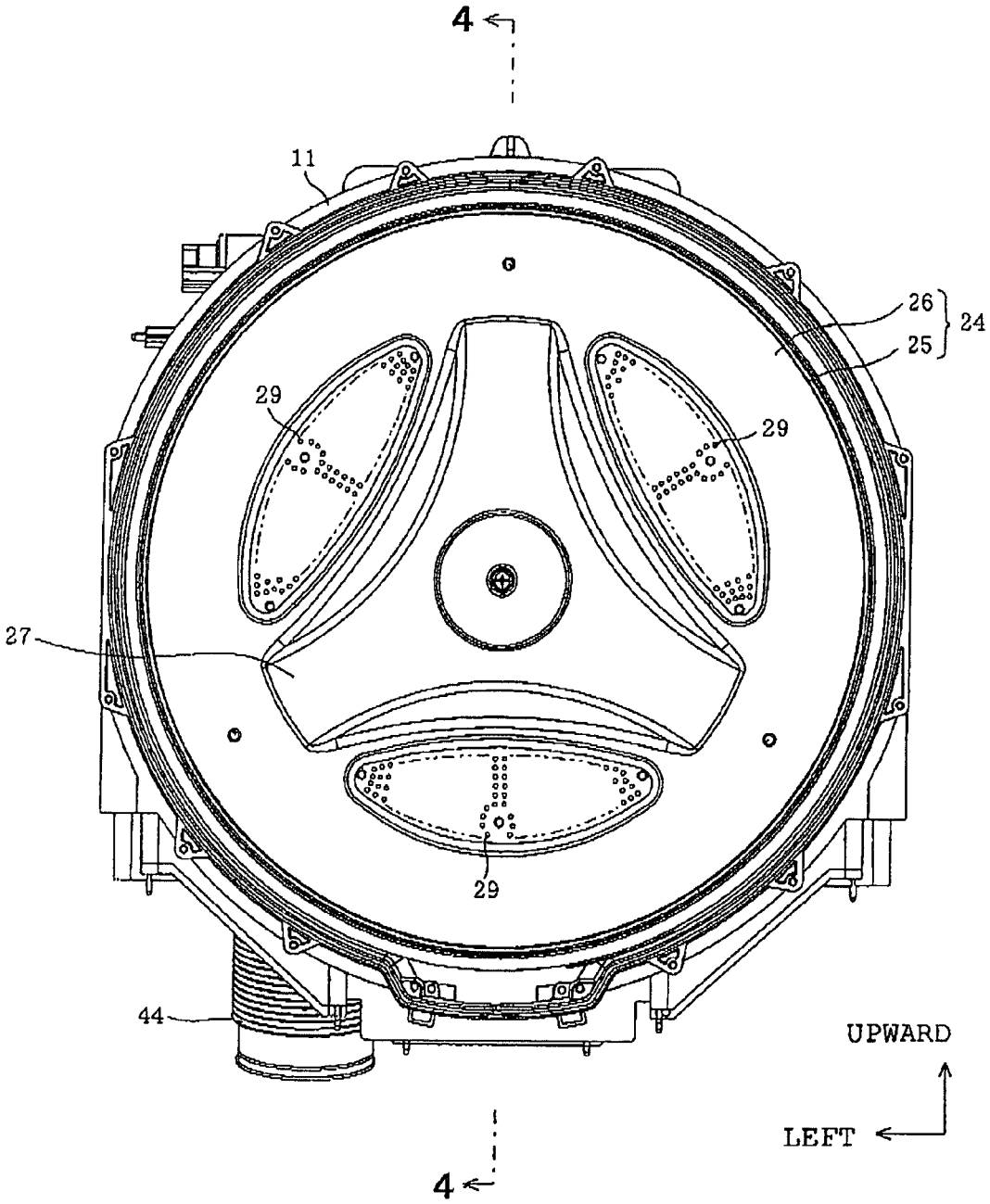
FIG. 5 is a front view of a water-receiving tub as viewed obliquely upward along a shaft center line of the tub.

A drum 24 is fixed to the rotational shaft 20 of the drum motor 17 so as to be located in the water-receiving tub 11 as shown in FIG. 4. When the drum motor 17 is driven, the drum 24 is rotated together with the rotational shaft 20. The drum 24 is housed in an inner space of the water-receiving tub 11 and constructed by joining an cylindrical body 25 and a circular bottom plate 26 both joined to each other. The bottom plate 26 has a triangular seat 27 as shown in FIG. 5. The seat 27 is screwed to the rotational shaft 20 thereby to be unrotatably fixed to the shaft 20. Clothes are put through the bellows 13 and the water-receiving tub cover 12 in turn into the drum 24 while the door 9 is open. The clothes are taken out of the drum 24 through the water-receiving tub 12 and the bellows 13 in turn.

A plurality of openings 28 are circumferentially formed in the bottom plate 26 of the drum 24 at regular pitches as shown in FIG. 4. Each opening 28 is formed into a hole extending through the bottom plate 26 in the direction of thickness of the bottom plate. Each opening 28 is covered with a net plate 29 as shown in FIG. 5. Each net plate 29 is formed into such a mesh that both air and water are allowed to flow therethrough. The inner space of the drum 24 communicates via the plural net plates 29 with the inner space of the water-receiving tub 11. The body 25 of the drum 24 is formed with a plurality of circulation holes 30 through which both air and water are allowed to be circulated, as shown in FIG. 4. The inner space of the drum 24 also communicates with the inner space of the water-receiving tub 11 through the circulation holes 30 as well as through the net plates 29.

A water supply valve (not shown) is provided in the outer cabinet 1. The water supply valve includes an input port connected to a faucet (not shown) and an output port connected to the inner space of the water-receiving tub 11. Water is supplied from the faucet through the water supply valve into the water-receiving tub 11 when the water supply valve is opened. A drain hose 31 is connected to the water-receiving tub 11 as shown in FIG. 2. The drain hose 31 is provided with a drain valve (not shown). When the drain valve is closed, water cannot be discharged through the drain hose 31. When the drain valve is opened, water is allowed to be discharged through the drain hose 31.

A lower duct 32 is housed in the outer cabinet 1 so as to be located below the water-receiving tub 11 as shown in FIG. 2. The lower duct 32 is formed into the shape of a square pipe and extends straight in the front-back direction. The lower duct 32 has both front and rear faces which are open and is fixed to the baseplate 2. A front hose 33 has a bellows-like lower end which is connected to the front face of the lower duct 32. The front hose 33 has an upper end connected to the water-receiving tub cover 12, whereby the inner space of the water-receiving tub 11 communicates via the front hose 33 with the inner space of the lower duct 32. An evaporator 34 and a condenser 35 are provided in the lower duct 32.

A compressor 36 is provided in the outer cabinet 1 so as to be located below the water-receiving tub 11. The compressor 36 is fixed to the baseplate 2. The compressor 36 has an outlet to which the condenser 35 is connected via a first relay pipe (not shown). The evaporator 34 is connected via a second relay pipe (not shown) to the condenser 35. The compressor 36 has an inlet to which the evaporator 34 is connected via a third relay pipe (not shown). The second relay pipe is provided with a pressure regulator (not shown). The compressor 36 is disposed outside the lower duct 32. During operation of the compressor 36, a refrigerant discharged from the outlet of the compressor 36 is supplied to the condenser 35 and the evaporator 34 in turn, being returned from the evaporator 34 to the inlet of the compressor 36. The compressor 36 includes a compressor motor (not shown) serving as a drive source.

A fan casing 37 is housed in the outer cabinet 1 so as to be located below the water-receiving tub 11. The fan casing 37 has an inlet connected to the rear face of the lower duct 32. The fan casing 37 is fixed to the baseplate 2. A fan 38 is provided in the fan casing 37 and is connected to a rotational shaft of a fan motor (not shown). During operation of the fan motor, air in the drum 24 is sucked through the front hose 33 into the lower duct 32. The sucked air is caused to pass through the evaporator 34 and the condenser 35 in turn, being sucked from the inlet of the fan casing 37 into the fan casing 37. The fan motor is fixed to the fan casing 37 and constitutes a blower 38 together with the fan casing 37 and the fan 38.

Figure 3:
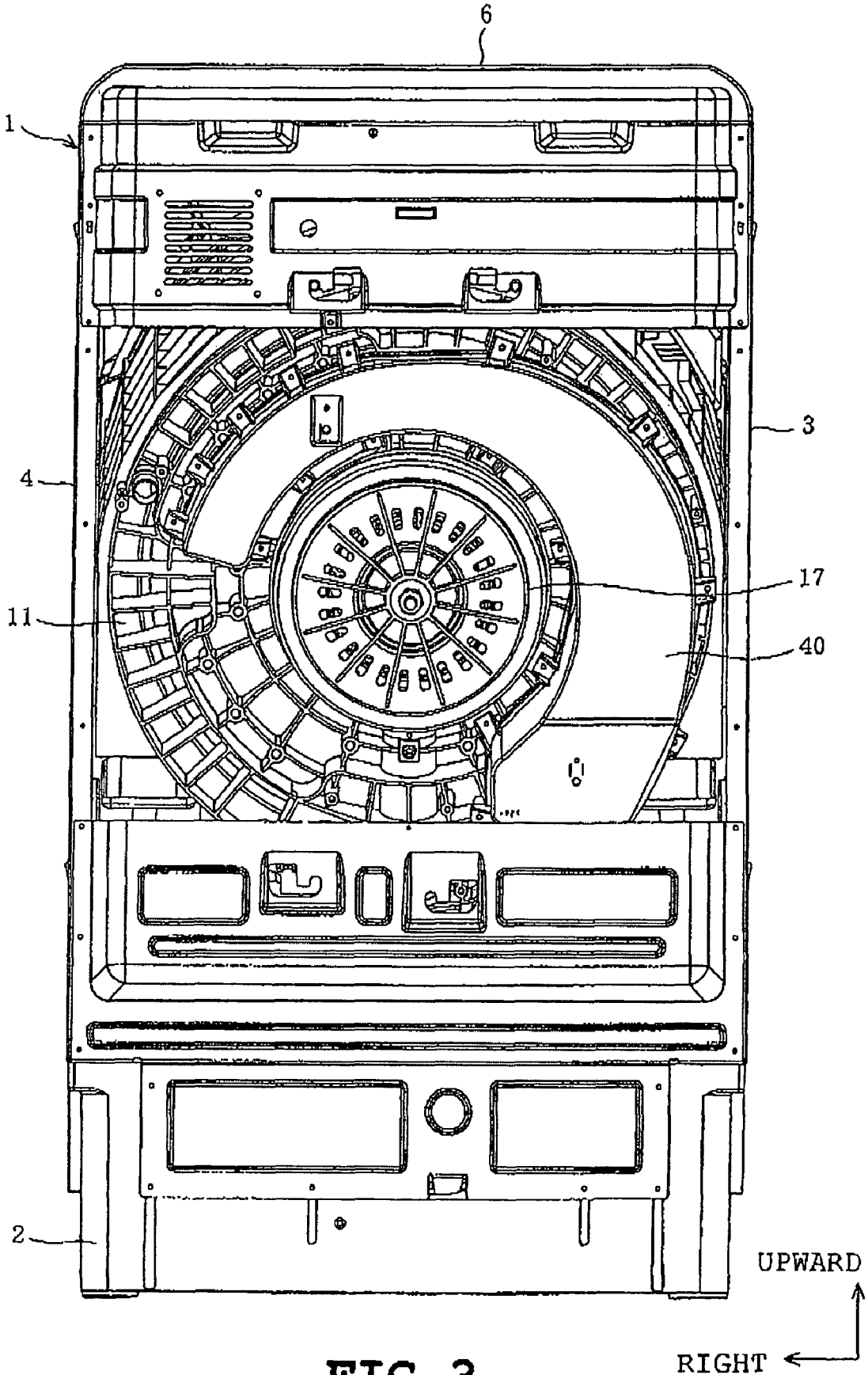
FIG. 3 is a rear view of the drum washer/dryer with a rear plate being eliminated, showing an inner construction.
Figure 6A:
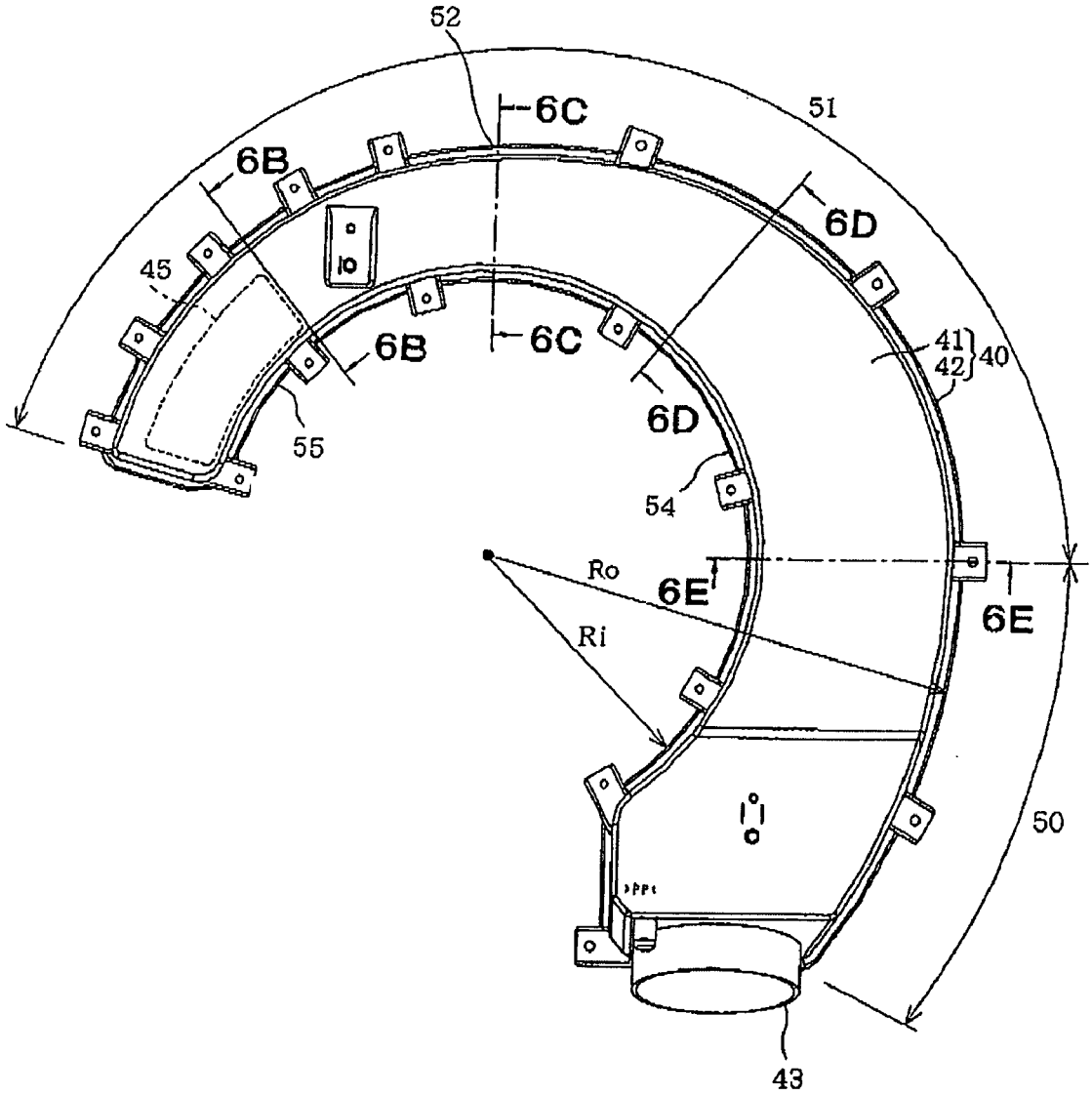
FIG. 6A is a rear view of a duct as viewed obliquely downward along the shaft center line.

A duct 40 is fixed to a rear plate of the water-receiving tub 11 as shown in FIG. 3. The drum motor 17 is disposed so as to be surrounded by the duct 40. The duct 40 is constructed by joining a rear duct cover 41 and a front duct cover 42 to each other into a tubular shape as shown in FIGS. 6B to 6E. The rear duct cover 41 has an open front and the front duct cover 42 is formed into a plate-shape and closes the front of the rear duct cover 41. The rear duct cover 41 has a lower end formed with an entrance 43 as shown in FIG. 6A. The entrance 43 is formed into a cylindrical shape and has an outer circumference to which a bellows-like upper end of the rear hose 44 is connected as shown in FIG. 7. The rear hose 44 has a lower end connected to the outlet of the fan casing 37 as shown in FIG. 2. Air sucked into the fan casing 37 during operation of the fan motor is caused to pass through the outlet of the fan casing 37 and the entrance 43 of the rear hose 44 in turn thereby to enter the duct 40, thereafter going upward in the duct 40 as shown by a broken line arrow in FIG. 7. The front duct cover 42 of the duct 40 is formed with a though-hole-like exit 45 as shown in FIG. 6A. The exit 45 is disposed in an end of the front duct cover 42 opposed to the entrance 43. Air flowing in the duct 40 exits from the exit 45.

A vent hole 46 is formed in the motor mounting 16 as shown in FIG. 4. The vent hole extends through the motor mounting 16 in the thickness direction and is formed into the shape of a passage inclined downward from the front toward the rear. The vent hole 46 is disposed in front of the exit 45 of the duct 40 so as to be opposed to the exit 45. Air exited from the exit 45 enters the vent hole 46. A blowhole 47 is disposed ahead of the vent hole 46 so as to be opposed to the vent hole 46. The blowhole 47 is formed into a cylindrical shape and extends through the rear plate of the water-receiving tub 11. Air exited from the duct 40 enters through the vent hole 46 into the blowhole 47. The blowhole 47 is designed to be opposed to one of a plurality of net plates 29 according to a mechanical rotational angle of the drum 24. Air having entered into the blowhole 47 is capable of flowing linearly through one of the net plates 29 into drum 24.

The hose 33, the lower duct 32, the rear hose 44 and the duct 40 constitute an air circulation passage 48 (see FIG. 2) having a start and an end thereof in the inner space of the drum 24. A blower 39 is provided for causing air to flow along the circulation passage 48. The blower 39 draws air from the inner space of the drum 24 and circulates the air in such a direction that the air is returned through the duct 40 and the blowhole 47 in turn into the inner space of the drum 24. The condenser 35 is disposed in the circulation passage 48 so as to be located upstream of the duct 40 relative to the blowhole 47. The evaporator 34 is disposed in the circulation passage 48 so as to be located upstream of the condenser 35. The evaporator 34, the condenser 35, the compressor 36 and the blower 39 constitute a heat pump type drying mechanism 49 (see FIG. 2). The evaporator 34 cools air drawn from the drum 24 thereby to dehumidify the air. The condenser 35 applies heat to the air dehumidified by the evaporator 34, thereby increasing the temperature of the air. More specifically, both evaporator 34 and condenser 35 generate high-temperature and low-humidity drying air. The drying air generated by the evaporator 34 and the condenser 35 is sent through the duct 40 and the blowhole 47 in turn into the drum 24, so that laundry in the drum 24 is blasted by the high-temperature and low-humidity drying air.

Figure 6B:
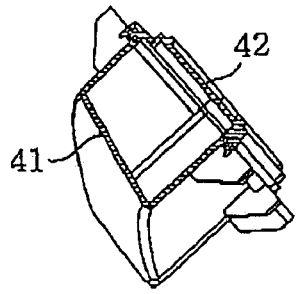
FIG. 6B is a section taken along line 6B-6B in FIG. 6A.
Figure 6C:
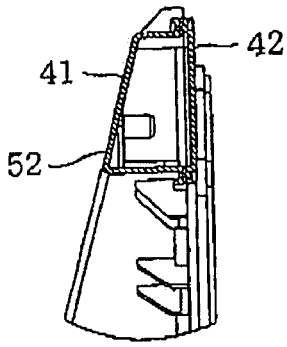
FIG. 6C is a section taken along line 6C-6C in FIG. 6A.
Figure 6D:
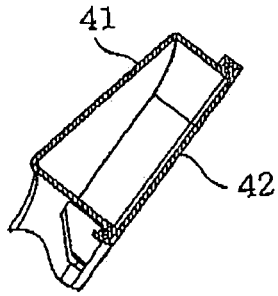
FIG. 6D is a section taken along line 6D-6D in FIG. 6A.
Figure 6E:
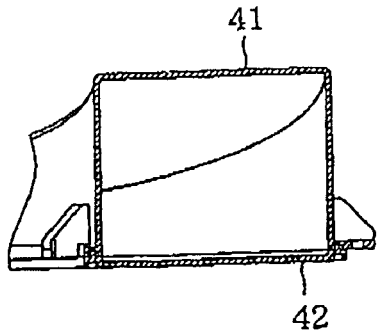
FIG. 6E is a section taken along line 6E-6E in FIG. 6A.
Figure 7:
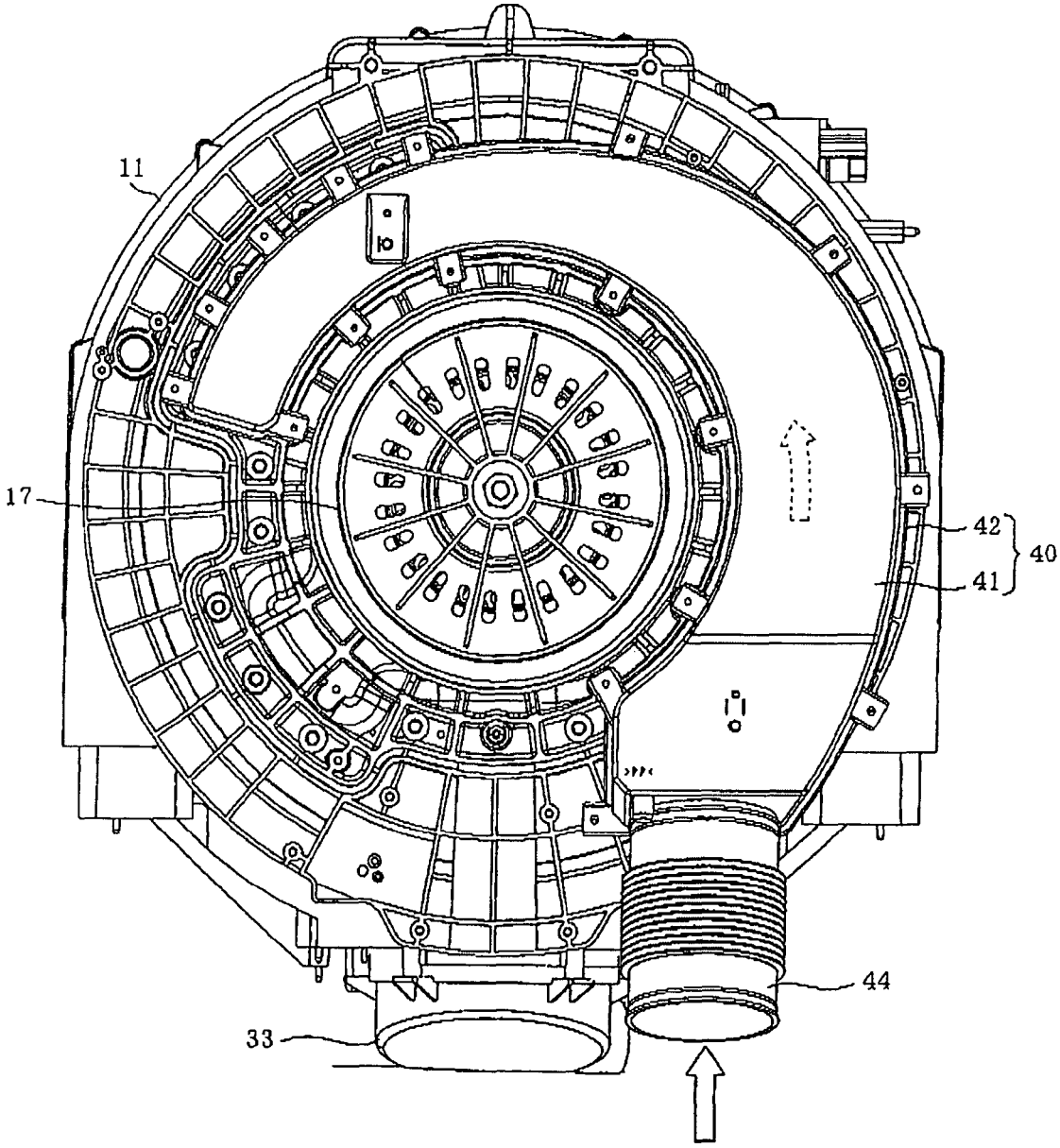
FIG. 7 is a rear view of the water-receiving tub as viewed obliquely downward along the shaft center line.

FIG. 6B is a section of the duct 40 taken along line 6B-6B in FIG. 6A. FIG. 6C is a section of the duct 40 taken along line 6C-6C in FIG. 6A. FIG. 6D is a section of the duct 40 taken along line 6D-6D in FIG. 6A. FIG. 6E is a section of the duct 40 taken along line 6E-6E in FIG. 6A. Lines 6B-6B to 6E-6E are cross-section lines intersecting a direction in which air flows in the duct 40. The duct 40 is formed into such a helical shape that the duct 40 is curved so that an outer diameter Ro thereof is gradually decreased from entrance 43 toward the exit 45 with an inner diameter Ri being constant. The duct 40 has a low flow rate region 50 and a high flow rate region 51.

The low flow rate region 50 refers to a region where a space broken along the cross-section line intersecting the direction in which air flows in the duct 40 has a rectangular section, as shown in FIG. 6E. The low flow rate region 50 is set at the upper stream side which is the entrance 43 side. The high flow rate region 51 refers to a region where a space broken along the cross-section line intersecting the direction in which air flows in the duct 40 has a trapezoidal section, as shown in FIGS. 6B to 6D. The high flow rate region 51 is set at the lower stream side which is the exit 45 side. The high flow rate region 51 has a cross-sectional area which is set at every part so as to be smaller than the minimum cross-sectional area of the low flow rate region 50. As a result, air having entered into the duct 40 during operation of the fan motor flows at lower speeds in the low flow rate region 50 than in the high flow rate region 51 and flows at higher speeds in the high flow rate region 51 than in the low flow rate region 51.

The duct 40 is formed with a backflow preventing portion 52 located in the high flow rate region 51 as shown in FIG. 6A. The backflow preventing portion 52 is disposed at the top of the duct 40 which is the highest when the duct 40 is fixed to the water-receiving tub 11. The duct 40 is formed into such a curved shape that the duct 40 has a left duct portion 54 extending leftward from the backflow preventing portion 52 serving as a starting point and a right duct portion 55 extending rightward from the backflow preventing portion 52 serving as a starting point. FIG. 6C shows a cross-sectional configuration of the backflow preventing portion 52. The backflow preventing portion 52 is set in the high flow rate region 51 and accordingly, a space broken along a cross-sectional line intersecting the direction in which air flows in the duct 40 has a smaller cross-sectional area than every remaining portion of the duct 40.

A control device 53 is provided in the outer cabinet 1 as shown in FIG. 2. The control device 53 is mainly composed of a microcomputer and has a central processing unit (CPU), a read only memory (ROM) and a random access memory (RAM). An operation control program is recorded on the ROM of the control device 53. The CPU controls the drive motor 17, a compressor motor, a fan motor, the water-supply valve and the drain valve based on the operation control program, thereby carrying out (1) a water-supply step to (9) a cooling step as described below.

(1) Water-Supply Step:

The drain valve is closed and the water-supply valve is opened so that water is stored in the water-receiving tub 11 with the water level in the water-receiving tub 11 according to the weight of the clothes.

(2) Wash Step:

The drum motor 17 is driven while both compressor motor and fan motor are stopped. Clothes in the drum 24 are raised upward while being stuck to the inner circumference of the drum 24, and thereafter, the clothes are removed from the inner circumference of the drum 24 thereby to fall into the water in the water-receiving tub 11, thereby being agitated. The wash step is carried out with detergent being dispensed into the water-receiving tub 11. Accordingly, the clothes are caused to fall into the water containing the detergent thereby to be washed by a beat wash manner. In the wash step, the water surface is set to be lower than the blowhole 47 even when the weight of the clothes is at the maximum. Accordingly, since the blowhole 47 is open, bubbles produced in the water-receiving tub 11 would sometimes flow back through the blowhole 47 into the duct 40.

(3) Drain Step:

The drain valve is opened so that water in the water-receiving tub 11 is discharged through the drain hose 31.

(4) Water-Supply Step:

The drain valve is closed and the water-supply valve is opened so that water is stored in the water-receiving tub 11 so that a set water level according to the weight of clothes is reached.

(5) Rinse Step:

The drum motor 17 is driven while both compressor motor and fan motor are stopped. Clothes in the drum 24 are raised upward while being stuck to the inner circumference of the drum 24, and thereafter, the clothes are removed from the inner circumference of the drum 24 thereby to fall into the water in the water-receiving tub 11, thereby being agitated. The rinse step is carried out without dispensing detergent into the water-receiving tub 11. Accordingly, the clothes are caused to fall into the water containing no detergent such that the detergent component is removed from the clothes. In the rinse step, the water surface is set to be lower than the blowhole 47 even when the weight of the clothes is at the maximum. Accordingly, since the blowhole 47 is open, bubbles produced in the water-receiving tub 11 would sometimes flow back through the blowhole 47 into the duct 40.

(6) Drain Step:

The drain valve is opened so that water in the water-receiving tub 11 is discharged through the drain hose 31.

(7) Dehydration Step:

The drum motor 17 is driven while both compressor motor and fan motor are stopped. The drum 24 is rotated while clothes are kept stuck to the inner circumference of the drum 24 without falling. In the dehydration step, water is centrifugally extracted from the clothes in the drum 24. The water extracted from the clothes is received by the water-receiving tub, from which the water is discharged through the drain hose 31.

(8) Drying Step:

The compressor motor and the fan motor are driven so that high-temperature low-humidity drying air is caused to blow against the clothes in the drum 24. In the drying step, the drum motor 17 is driven so that clothes in the drum 24 are raised upward while being stuck to the inner circumference of the drum 24, and thereafter, the clothes are removed from the inner circumference of the drum 24 thereby to fall, thus being agitated. The drying step corresponds to an operation for supplying drying air for drying the clothes in the drum 24 into the inner space of the drum 24.

(9) Cooling Step:

The fan motor is driven with the compressor motor being stopped so that so that cooling air having a lower temperature than the drying air is caused to blow against the clothes in the drum 24. The cooling air refers to air for which heat-exchange is not executed by the drying mechanism 49 or air with an ambient or room temperature. The cooling air is used to cool the clothes whose temperature has been increased in the drying step. In the cooling step, the drum motor 17 is driven so that clothes in the drum 24 are raised upward while being stuck to the inner circumference of the drum 24, and thereafter, the clothes are removed from the inner circumference of the drum 24 thereby to fall, thus being agitated. The drying step corresponds to an operation for supplying drying air for drying the clothes in the drum 24 into the inner space of the drum 24. The cooling step corresponds to an operation for supplying air having a lower temperature than the drying air into the inner space of the drum 24.

The following effects can be achieved from the foregoing embodiment. The duct 40 is formed with the backflow preventing portion 52 having a locally smaller sectional area. Accordingly, when bubbles flow back through the blowhole 47 into the duct 40 in each of the wash and rinse steps, the backflow preventing portion 52 serves as a resistance thereby to prevent backflow of the bubbles. Consequently, since the bubbles having flowed back into the duct 40 is prevented from entering through the rear hose 44 into the fan casing 37, the bubbles having flowed back into the duct 40 can be prevented from adhering to the condenser 35 and the evaporator 34.

The backflow preventing portion 52 is located on the top of the duct 40. Accordingly, when bubbles flow back through the blowhole 47 into the duct 40, an amount of energy necessary to reach the backflow preventing portion 52 is increased. As a result, the bubbles cannot easily reach the backflow preventing portion 52. Moreover, the bubbles having reached the backflow preventing portion 52 fall along the duct 40 to the blowhole 47 side without going over the backflow preventing portion 52. Consequently, the bubbles cannot easily adhere to the condenser 35 and the evaporator 34.

The water-receiving tub 11 is disposed in such an inclined state that an imaginary shaft center line CL becomes lower from a front part thereof to a rear part thereof. Accordingly, a space is defined between the rear plate of the water-receiving tub 11 and the vertical rear plate 7 of the outer cabinet 1. The space has a widthwise dimension that is gradually reduced from a lower part to an upper part thereof. The duct 40 is joined to the rear plate of the water-receiving tub 11. Consequently, since the duct 40 has a shape according to the space between the rear plate of the water-receiving tub 11 and the rear plate 7 of the outer cabinet 1, the backflow preventing portion with the minimum sectional area can easily be formed on the top of the duct 40.

The duct 40 has the left duct portion 54 extending leftward from the backflow preventing portion 52 serving as the starting point and the right duct portion 55 extending rightward from the backflow preventing portion 52 serving as the starting point. As a result, the backflow preventing portion 52 having the locally smaller sectional area is disposed in the middle of the duct 40. Accordingly, when air passes the backflow preventing portion 52 during operation of the fan motor, a flow rate of air is rendered higher than immediately before air passes the backflow preventing portion 52. Consequently, air can be supplied from the blowhole 47 through the net plate 29 into the drum 24 at a sufficient flow rate. Thus, since the drying air is blown against the clothes located away from the blowhole 47, a drying degree of the clothes located away from the blowhole 47 can be improved. This effect can also be applied to the cooling air.

The low flow rate region 50 is provided at the entrance 43 side of the duct 40, and the high flow rate region 51 is provided at the exit 45 side of the duct 40. Accordingly, a flow rate at which air passes through the high flow rate region is higher than a flow rate at which air passes through the low flow rate region during operation of the fan motor. Air discharged from the blowhole 47 has a higher flow rate than when an entire region of the duct 40 except the backflow preventing portion 52 is set at the same constant sectional area as the low flow rate region. As a result, since air can be supplied from the blowhole 47 through the net plate 29 into the drum 24 at a sufficient flow rate, the drying air is blown against the clothes located away from the blowhole 47, a drying degree of the clothes located away from the blowhole 47 can be improved. Moreover, the backflow preventing portion 52 is disposed in the high flow rate region 51. Accordingly, since the flow rate of air discharged from the blowhole 47 is further increased, the drying degree of the clothes located away from the blowhole 47 can further be improved. This effect can also be applied to the cooling air.

The cooling step is carried out in addition to the drying step in which both compressor 36 and blower 39 are driven so that the drying air is supplied into the inner space of the drum 24. In the cooling step, the blower 39 is driven with the compressor 36 being stopped so that the cooling air is supplied into the inner space of the drum 24. Clothes whose temperature has been increased as the result of execution of the drying step can be cooled and thereafter be taken out.

The invention should not be limited to the foregoing embodiment. The embodiment may be modified as follows.

The location of the backflow preventing portion 52 should not be limited to the top of the duct 40. The backflow preventing portion 52 may be located in the middle of the duct 40 between the entrance 43 and the exit 45.

The right duct portion 55 should not be limited to the curved shape but may be formed into a linear shape in which the right duct portion 55 extends horizontally in the longitudinal direction.

The low flow rate region 50 and the high flow rate region 51 are not essential constituents, but an entire region of the duct 40 except the backflow preventing portion 52 may be set at the same constant sectional area as the low flow rate region 50, for example.

INDUSTRIAL APPLICABILITY

As described above, the drum-type washer/dryer of the invention is useful as a drum-type washer/dryer which can prevent bubbles produced in a drum from adhering to an evaporator and a condenser.

The invention claimed is:

1. A drum-type washer/dryer which incorporates a drum into which laundry is put and comprises:

a water-receiving tub receiving water discharged from the laundry in the drum;

a blowhole provided in the water-receiving tub so that air is supplied to an inner space of the drum therethrough;

a duct connected to the blowhole;

an air circulation passage having a start and an end thereof in the inner space of the drum and formed into a loop, the air circulation passage including the duct;

a blower drawing air from the inner space of the drum and circulating the air in such a direction that the air is returned through the duct and the blowhole in turn into the inner space of the drum;

a condenser provided in the circulation passage so as to be located upstream of the duct relative to the blowhole;

an evaporator provided in the circulation passage so as to be located upstream of the condenser; and a compressor causing a refrigerant to flow into the evaporator and the condenser, characterized in that the duct includes a backflow preventing portion which serves as a resistance preventing backflow of a bubble when the bubble flows back from the inner space of the drum through the blowhole into an interior of the drum, the backflow preventing portion has a smaller cross-sectional area than a remaining portion of the duct, the cross-sectional area being obtained by fracturing the duct along a section line perpendicular to a flowing direction of the air in the duct.

2. The drum-type washer/dryer according to claim 1, characterized that the water-receiving tub has a closed rear and is formed into a bottomed cylindrical shape, the water-receiving tub having a shaft center line disposed in such an inclined state that the shaft center line becomes lower from a front part thereof to a rear part thereof, and the water-receiving tub has a rear plate in which the blowhole and the duct are provided.

3. The drum-type washer/dryer according to claim 2, characterized that the duct includes a left duct extending leftward from the backflow preventing portion and a right duct extending rightward from the backflow preventing portion.

4. The drum-type washer/dryer according to claim 1, further characterized by a control device controlling the blower and the compressor and in that the control device is capable of carrying out a first operation in which both blower and compressor are operated so that a dry air for drying the laundry is supplied into the inner space of the drum and a second operation in which the blower is operated with the compressor being stopped so that air which has a lower temperature than the dry air is supplied into the inner space of the drum.

* * * * *